United States Patent [19]

Williams

[11] 4,307,484

[45] Dec. 29, 1981

[54] CLEANING APPARATUS AND METHOD

[75] Inventor: Robert C. Williams, Smithfield, N.C.

[73] Assignee: U.S. Floor Systems, Inc., Raleigh, N.C.

[21] Appl. No.: 79,803

[22] Filed: Sep. 28, 1979

[51] Int. Cl.[3] ..... A47L 7/00

[52] U.S. Cl. ..... 15/321; 15/322; 15/353

[58] Field of Search ..... 15/320, 321, 322, 353

[56] References Cited

U.S. PATENT DOCUMENTS 3,705,437 12/1972 Rukavina et al. ..... 15/322 X 3,711,891 1/1973 Conway ..... 15/322 X 4,069,541 1/1978 Williams et al. ..... 15/321

*Primary Examiner*—Chris K. Moore

*Attorney, Agent, or Firm*—Bell, Seltzer, Park & Gibson

[57] ABSTRACT

Apparatus and method for cleaning surfaces such as carpet and the like by the application of liquid and the vacuum extraction of liquid from the surface to be cleaned wherein operation in a selected one of two modes is facilitated. One mode of cleaning involves spraying an application of liquid. The other mode of operation involves sheeted application of liquid and subjects the liquid to ultrasonic vibration before extraction. Particular characteristics are described which enhance selectivity of cleaning in these two modes.

7 Claims, 12 Drawing Figures

CLEANING APPARATUS AND METHOD

FIELD AND BACKGROUND OF THE INVENTION

Substantial commerce has been built about the cleaning of surfaces, and particularly textile fabric surfaces such as carpet, upholstery and the like, by the practice of methods and the use of apparatus characterized as liquid spray and vacuum pick-up methods and apparatus. Examples of such methods and apparatus may be found in Emrick et al U.S. Pat. No. 3,883,301 issued May 13, 1975 and Williams et al U.S. Pat. No. 4,069,541 issued Jan. 24, 1978. To the extent that the disclosures of those prior patents are appropriate or necessary to a full understanding of the present invention, the disclosures to be found there are hereby incorporated by reference into the present specification.

Commercial activity using the methods and apparatus as known heretofore has included two major fields. First, homeowners and others may, from time to time, rent apparatus offered through rental locations such as hardware stores, dry cleaning establishments and the like. Such rental apparatus is used for "do it yourself" cleaning of carpet and the like in a homeowner's residence or the like. In the past, substantially similar apparatus has been used by commercial carpet cleaners who sell services as distinct from renting apparatus. Typically, such a commercial carpet cleaning service may be hired by the owner of a public building for cleaning carpet used in such a building, although commercial cleaning services also offer household carpet cleaning services in competition with machine rentals for "do it yourself" homeowners.

As such commerce has developed, it has become important to the operator of a commercial carpet cleaning service that the cleaning apparatus used facilitate achieving optimal cleaning. That is, commercial carpet cleaning services are conventionally priced on a unit area basis. Thus, while a "do it yourself" homeowner may be willing to spend substantial time cleaning or attempting to clean a specific area, a commercial carpet cleaning service has as an objective the efficient cleaning of the area with a minimum expenditure of time.

One problem faced by both the homeowner and the commercial carpet cleaning service is the differing dirtiness of carpet in heavy traffic and low traffic areas. As is known, any path across a carpeted area which carries heavier traffic becomes more dirty. Thus, a person cleaning the carpet is faced with carpet areas of differing dirtiness and cleaning techniques must be adapted to the varying needs. Heretofore such adaptation of cleaning techniques has included the use of more powerful cleaning agents known as traffic spotters and more concentrated effort for longer intervals of time in use of the cleaning apparatus employed.

BRIEF DESCRIPTION OF THE INVENTION

With the problems and difficulties discussed above particularly in mind, it is an object of this invention to provide a liquid application and vacuum pick-up cleaning apparatus and method which include improvements facilitating effective operation in a selected one of two modes so as to accommodate variations in dirtiness and other characteristics of surfaces being cleaned. In realizing this object of the present invention, provisions are made for ready selection of either spray application and vacuum pick-up or pooling application, ultrasonic treatment, and vacuum pick-up. Selection of spraying solution onto the surface to be cleaned and vacuuming without ultrasonic treatment has advantages of more quickly cleaning areas of lesser dirtiness. Selection of pooling of solution and transmitting to the solution mechanical vibration at ultrasonic frequencies is somewhat slower, but is more effective in cleaning more heavily trafficked areas of greater dirtiness.

Yet a further object of the present invention is to facilitate control by an operator over cleaning effectiveness of the method and apparatus briefly described above. In realizing this object of the present invention, operating characteristics of the method are monitored and are then varied in order to optimize cleaning. In particular, the volume rate of flow of solution delivered, the power transmitted as mechanical vibration at ultrasonic frequencies, and the temperature of the solution being used are parameters affecting cleaning efficiency.

BRIEF DESCRIPTION OF DRAWINGS

Some of the objects of the invention having been stated, other objects will appear as the description proceeds, when taken in connection with the accompanying drawings, in which.

DETAILED DESCRIPTION OF THE INVENTION

While the apparatus and method of the present invention will be described more particularly hereinafter, it is to be noted at the outset of this description that it is contemplated that certain of the characteristics of the invention here to be described may be varied while still achieving the desirable result of this invention. Accordingly, the description which follows is to be read broadly as instructing persons skilled in the applicable arts concerning this invention, and not as restrictive on the scope of this invention.

Figure 1:
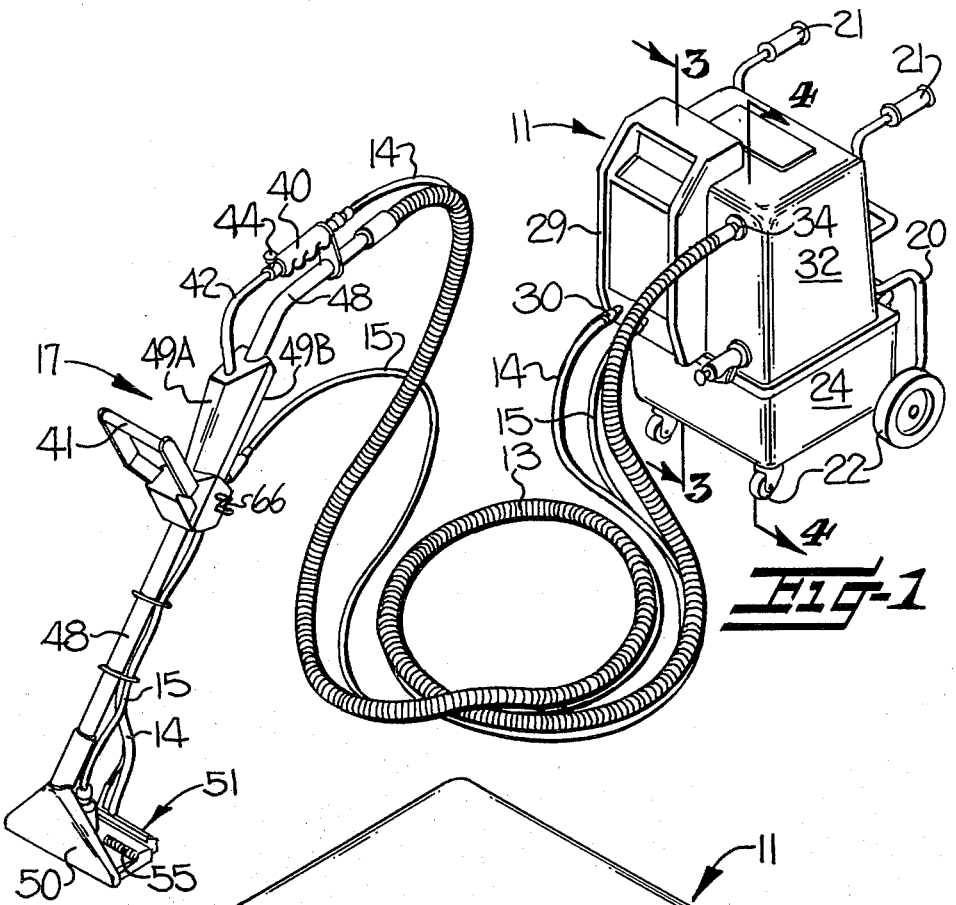
FIG. 1 is a perspective view of the apparatus of the present invention.

Referring now more particularly to the accompanying drawings, FIG. 1 is a perspective view of a liquid application and vacuum pick-up cleaning apparatus in accordance with the present invention. The apparatus has a tank and power unit generally indicated at 11 with liquid storage means for storing liquid as described more fully hereinafter, pump means for supplying a flow of liquid, vacuum means for sucking air and liquid, and driver means for driving an ultrasonic transducer. By means of appropriate vacuum hose 13, solution hose 14 and electrical conductor cable 15, the tank and power unit 11 is connected with operating elements of a wand generally indicated at 17. The wand 17 has liquid application nozzles as described more fully hereinafter for applying liquid to a surface to be cleaned and operatively communicating with the pump means through the solution hose 14. It also has vacuum nozzle means for extracting liquid from the surface to be cleaned and operatively communicating with the vacuum means through the suction hose 13. It also has ultrasonic transducer means mounted intermediate the nozzles and operatively connected with the driver means through the electrical conductor cable 15 for subjecting liquid applied to the surface to be cleaned to agitation at ultrasonic frequencies after application and before extraction thereof. As is pointed out hereinafter, the structure and cooperation of the tank and power unit 11 and wand 17 may be generally as described in prior U.S. Pat. Nos. 3,883,301 and 4,069,541.

Referring now more particularly to the tank and power unit 11, that unit, in the form shown, is particularly constructed and arranged for ready transport by an operator and for facilitating certain functional steps. More particularly, the unit 11 includes a rolling frame 20 having hand grips 21 and support wheels 22 for relatively easy movement of the unit to a location in which carpet or other surfaces are to be cleaned.

A lower portion of the unit 11, indicated at 24, defines a supply tank or reservoir for holding a solution of hot water and detergent or other liquid to be applied in cleaning. As will be noted, the supply reservoir defined by the lower portion 24 of the unit 11 includes an inlet area 25 (FIGS. 3 and 4) accessible from the rear side of the unit 11 and at a relatively low level so as to facilitate filling the supply reservoir from any convenient water tap or hose.

A pump 26 (FIG. 3), having particular characteristics to be described more fully hereinafter, communicates by means of an inlet tube 28 with the supply reservoir. However, the pump 26 is housed within a separate control housing portion 29 of the unit 11 which is substantially isolated from the solution tanks. Solution delivered by the pump 26 leaves the unit 11 by means of a quick detachable coupling 30 to be connected to the solution hose 14.

Figures 3, 4:
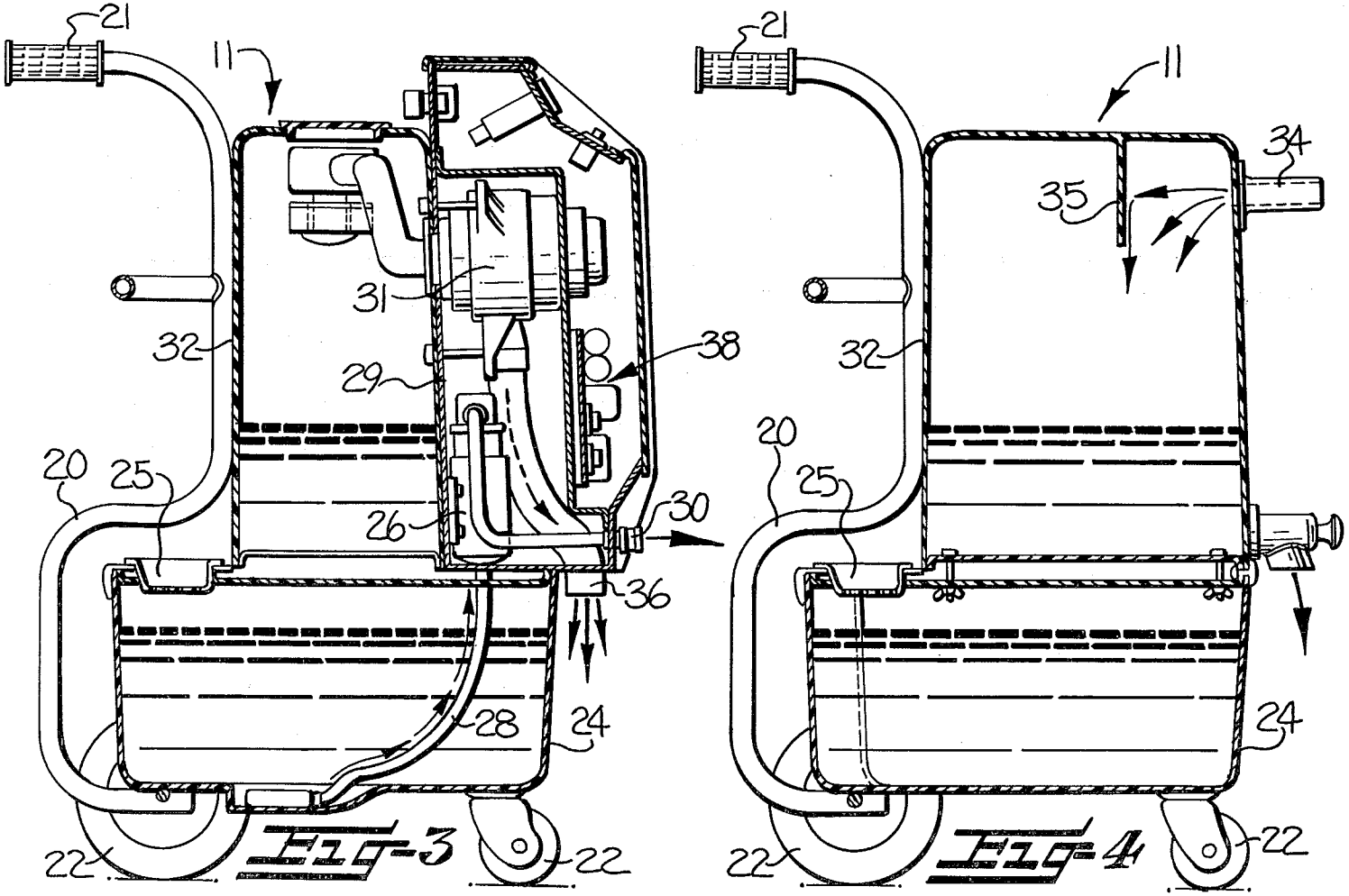
FIG. 3 is an enlarged vertical sectional view of the tank and power unit of the apparatus of FIG. 1, taken generally along the line 3—3 in FIG. 1.
FIG. 4 is a view similar to FIG. 3, taken along the line 4—4 in FIG. 1.

The housing 29 which encloses the pump 26 additionally encloses a vacuum means indicated at 31 and which communicates, by means of a solution receiving tank defined by an upper portion 32 of the unit 11, with an inlet coupler 34 (FIGS. 1 and 4) and the suction hose 13. A suction flow of air drawn by the vacuum means 31 into the solution receiving tank impinges against an interior baffle 35, brings about separation of liquid and air, and the air flow passes through the vacuum means to be exhausted through an outlet 36 (FIG. 3). As is generally known in the manufacture and use of wet-dry vacuum cleaners, an appropriate float valve or other means is provided to protect the vacuum means 31 against the entry of water thereinto.

Figure 2:
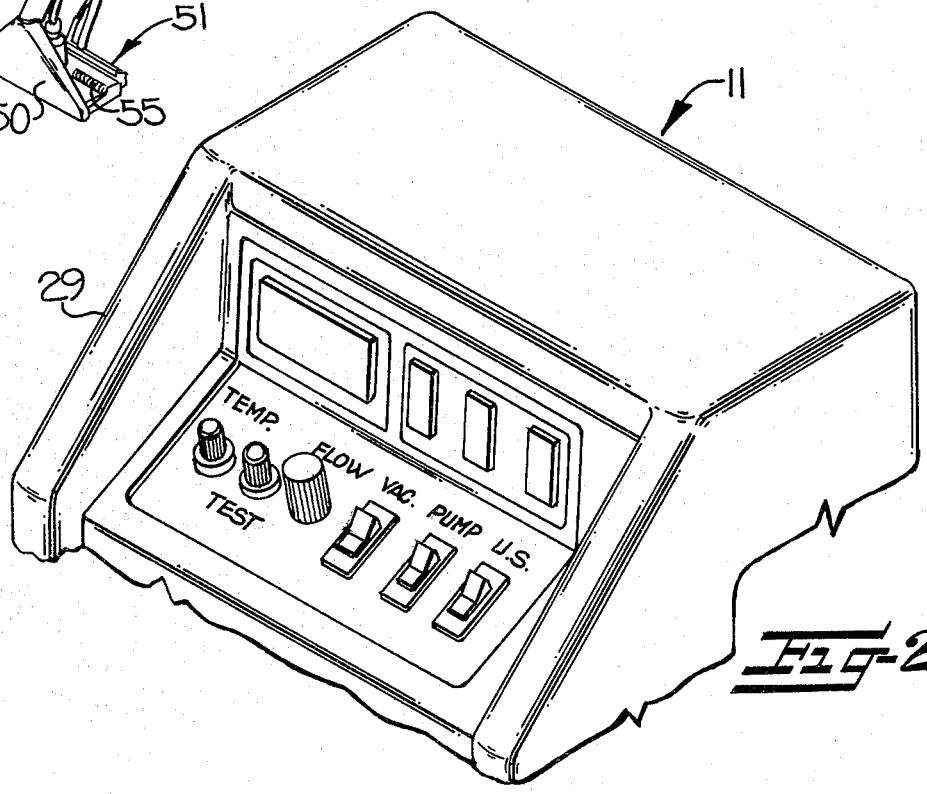
FIG. 2 is an enlarged perspective view of a portion of the tank and power unit portion of the apparatus of FIG. 1.

Also disposed within the housing 29 are appropriate electronic circuits, generally indicated at 38, for performing a number of functions. These electronic circuits include driver means for driving an ultrasonic transducer. Preferably, such a driver means includes electrical oscillator means for generating oscillating electrical currents having frequencies above 18 kilohertz, such as in the range of from about 20 to about 50 kilohertz. Such oscillator circuits and suitable magnetostrictive or the like transducers are available from sources such as Branson Instruments, Inc. of Stamford, Connecticut, and interested readers are directed to literature available from that source should additional information be deemed desirable. Frequencies in the range described are, as is generally known, above the normal upper frequency threshold for human hearing and for that reason have been conventionally referred to heretofore as "ultrasonic". The circuitry additionally includes means for monitoring the temperature of solution contained in the supply reservoir in the lower portion 24 of the unit 11, means for monitoring the volume rate of flow of solution delivered by the pump 26, and means for monitoring the power delivered from the driver means to the ultrasonic transducer as described more fully hereinafter. Preferably, a control panel (FIG. 2) is provided at an upper portion of the housing 29. Such a panel may include switch controls for the pump 26, the vacuum means 31, and the driver means for the ultrasonic transducer. Additionally, the control panel may include a digital or analogue indicator or gauge, to indicate visually to an operator the various monitored functions. For example, volume rates of flow may be indicated numerically in gallons per minute or liters per minute. Solution temperatures may be indicated in degrees Fahrenheit or Celsius. Power delivered from the driver means may be indicated in any appropriate manner. Appropriate test and temperature calibration controls may be provided.

In accordance with one important characteristic of the present invention as described more fully hereinafter, the pump 26 preferably is driven by an electrical motor which is operatively connected with a speed control circuit included within the electronic circuitry generally indicated at 38. Such speed control circuits are generally known to persons skilled in the arts of controlling electrical motors, and therefore need not be here described in great detail. By the provision of an appropriate control at the panel in the upper portion of the housing 29, the speed of the pump 26 may be varied so as to vary the volume rate of flow of solution supplied to the wand 17.

While the volume rate of flow may thus be varied, the characteristics of the pump 26 are such that volume rate is relatively independent of pressure output. That is, as the pressure required to be delivered by the pump changes with selection of modes of operation as described more fully hereinafter, the volume delivered changes minimally. This is an important characteristic of this invention, as it facilitates ready operation in a selected one of two modes.

Referring now more particularly to FIGS. 5 through 12, the wand 17 is constructed and arranged so as to facilitate optimal cleaning through use of the apparatus and method of the present invention. In particular, a pair of operator hand grips 40, 41 are provided and are arranged for ready manipulation of the wand 17 by an operator. One hand grip 40 encircles a solution conduit 42 operatively coupled with the solution hose 14, and is positioned adjacent a thumb valve 44 by which the delivery of solution through the wand 17 is controlled. The other hand grip 41 encloses a thumb switch 45 which is electrically connected by means of the conductive cable 15 with the driver means so as to control the subjection of liquid applied to the surface to be cleaned to agitation at ultrasonic frequencies as described more fully hereinafter.

In the form illustrated, the wand 17 includes an appropriate analogue gauge 46 electrically connected to visually indicate to an operator manipulating the wand 17 the power delivered from the driver means to the ultrasonic transducer. Thus, an operator manipulating the wand 17 may observe directly at the wand the extent to which power is being delivered, as described more fully hereinafter.

The wand 17 includes, as a central stem, a suction conduit 48 operatively communicating with the vacuum hose 13. Preferably, as an appearance factor, a decorative housing 49A, 49B fixed to the suction conduit 48 shields certain of the connections for the wand 17.

The surface to be cleaned is engaged by certain elements of the wand remote from the hand grips 40, 41, as more particularly shown in FIGS. 7 through 12. As there illustrated, the surface engaging end of the wand 17 includes a suction nozzle 50 fixed to and communicating with a lower end of the suction conduit 48. Mounted to a rearward face of the suction nozzle 50 is a carriage portion generally indicated at 51 on which are mounted an ultrasonic transducer generally indicated at 52, a transducer bar 54 mechanically coupled with the transducer 52, solution spreading rolls 55, and liquid application nozzles generally indicated at 56. A suitable threaded adjustment 57 is provided to control the relative engagement of the transducer bar 54 with the surface being cleaned, as described more fully hereinafter.

In accordance with important characteristics of the present invention, the liquid application nozzles are mounted and arranged in a particular manner so as to facilitate effective operation in either selected one of two modes. Further, the nozzles cooperate with a sheeting means as now will be more fully described.

Figure 11:
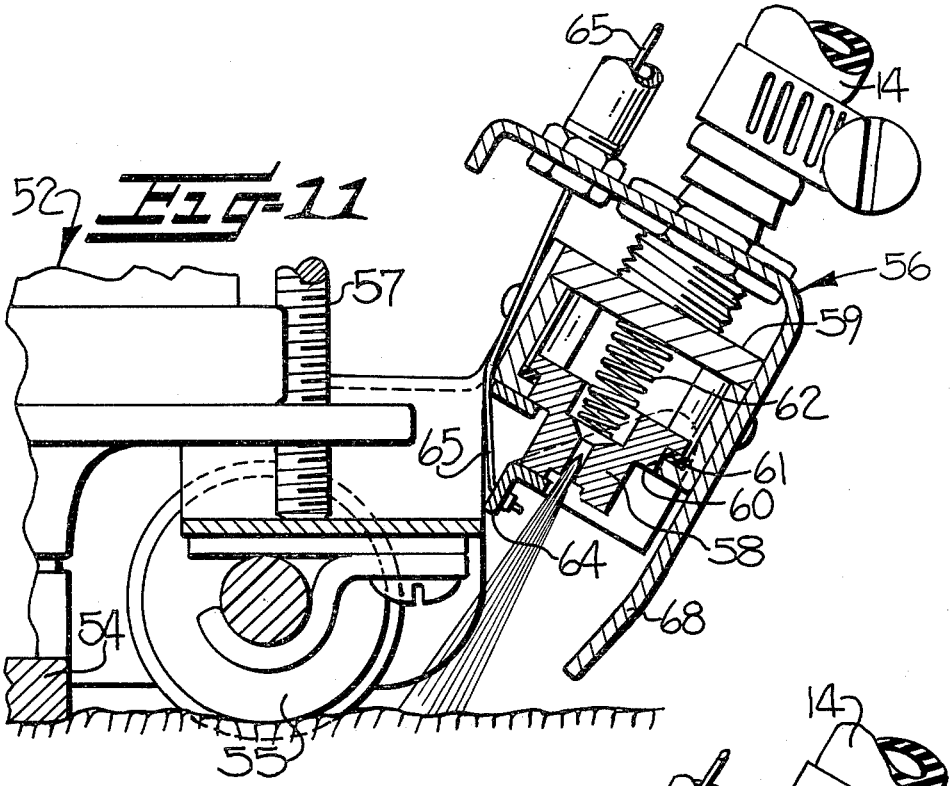
FIG. 11 is an enlarged side elevation view, partially in section, showing certain of the wand elements shown in FIGS. 7 through 10 as positioned for operation in a selected one of two modes.

In particular, the nozzles include a plurality (here shown as eight) of nozzle members 58 through and about which liquid may be directed. The members 58 are housed within a manifold 59 which is drilled to define a corresponding plurality of seat means (one of which is visible at 60 in FIGS. 11 and 12). By means of appropriate gaskets 61 and biasing springs 62, the nozzle members 58 when engaged with the seat means 60 and gaskets 61 under the urging of the springs 62 are sealed against liquid flow thereabout. Accordingly, liquid is directed through respective confined outlet openings of the nozzle members 58 and delivered as a pressurized spray onto a surface to be cleaned (FIG. 11). However, the nozzle members 58 and manifold 59 also define relatively unconfined outlet openings when the nozzle members are unseated as now to be described.

Figure 5:
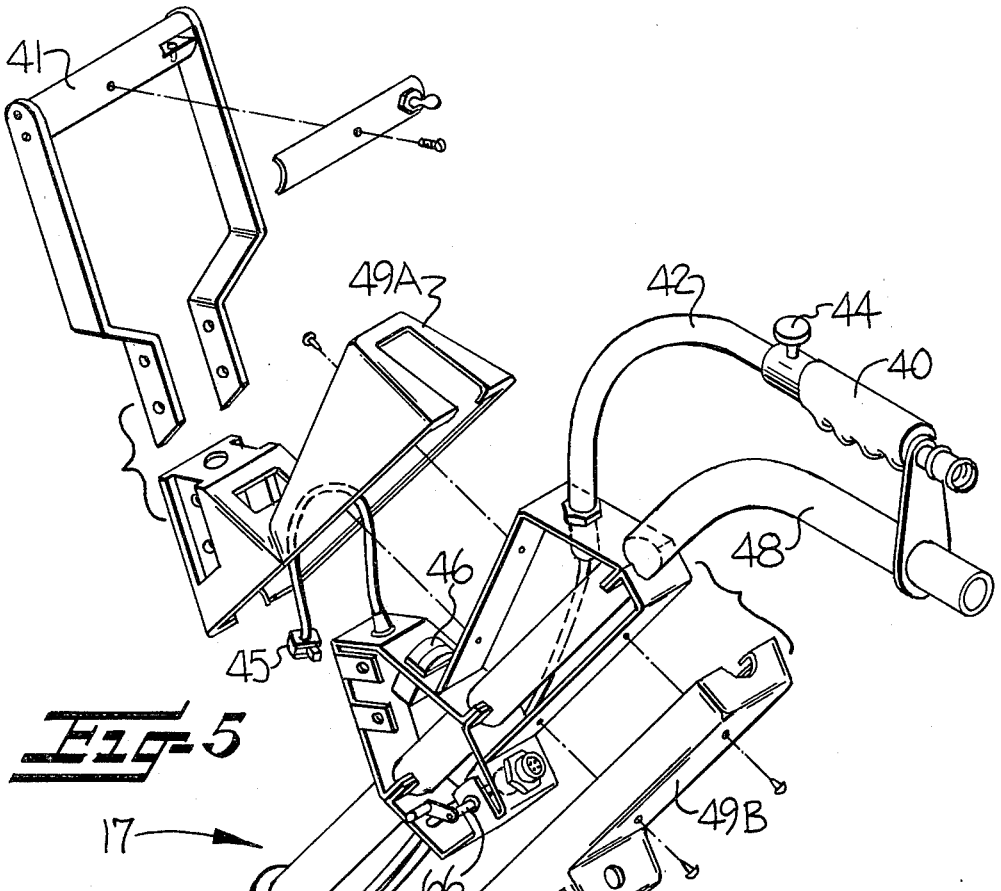
FIG. 5 is an exploded perspective view of a portion of a wand included in the apparatus of FIG. 1.
Figure 6:
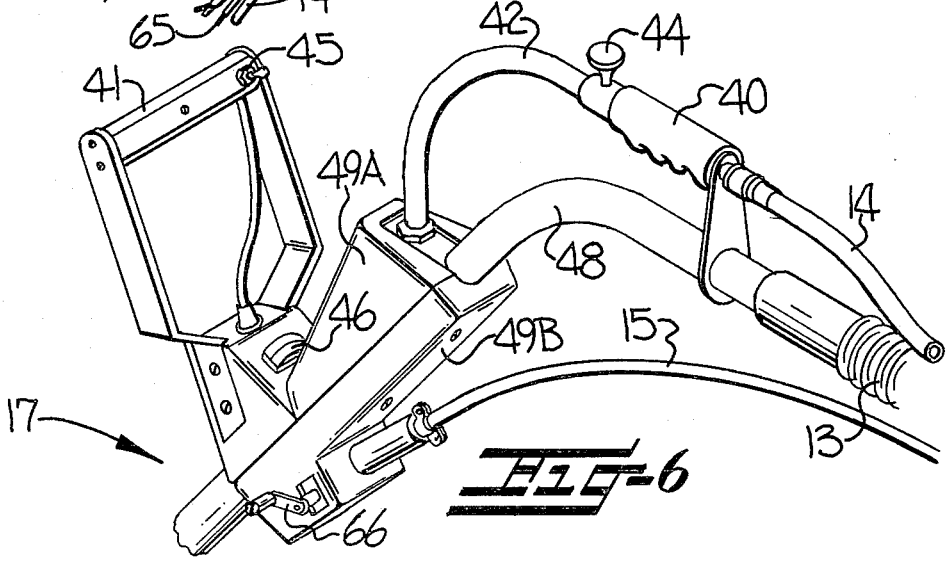
FIG. 6 is an assembled perspective view similar to FIG. 5.
Figure 12:
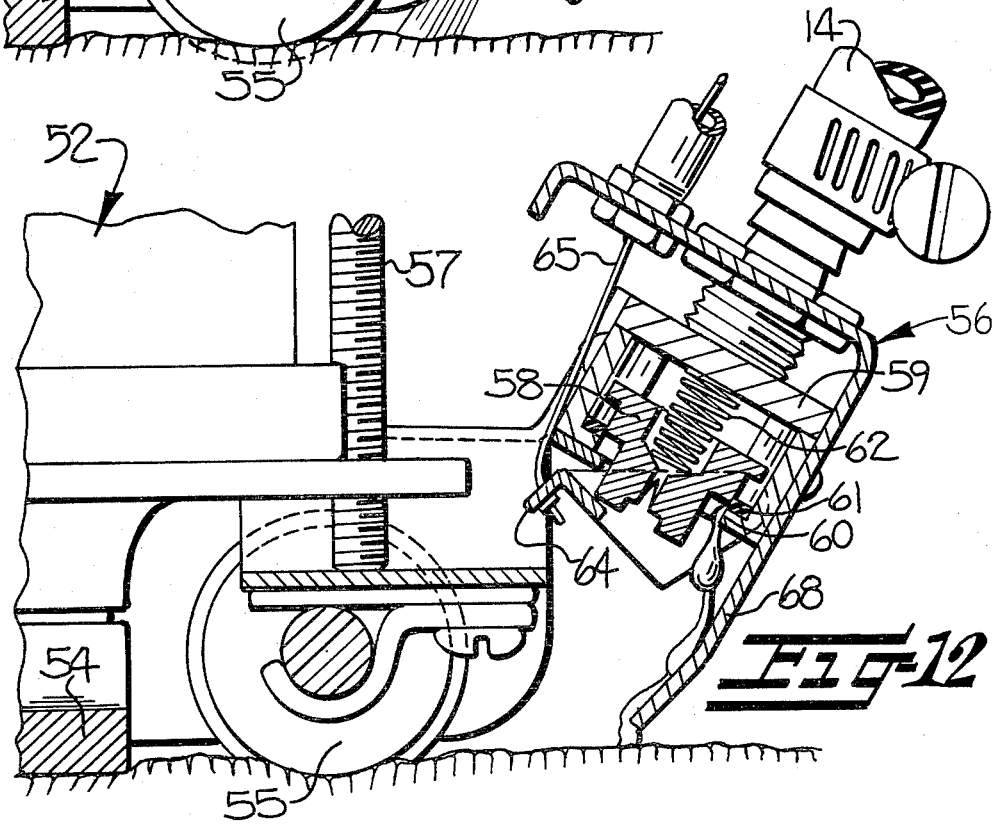
FIG. 12 is a view similar to FIG. 11, showing the elements as positioned for operation in the other of the two modes.

Mounted for movement adjacent the liquid application nozzles is a manually operable sheeting means 64. By means of a suitable Bowden wire 65 or other mechanical means, the position of the sheeting means 64 may be controlled by operator manipulation of a handle 66 positioned near one hand grip 41 of the wand 17 (FIGS. 5 and 6). Thus, an operator manipulating the wand 17 may readily move the sheeting means 64 between a withdrawn position (FIG. 11) and a sheeting position (FIG. 12).

Figure 10:
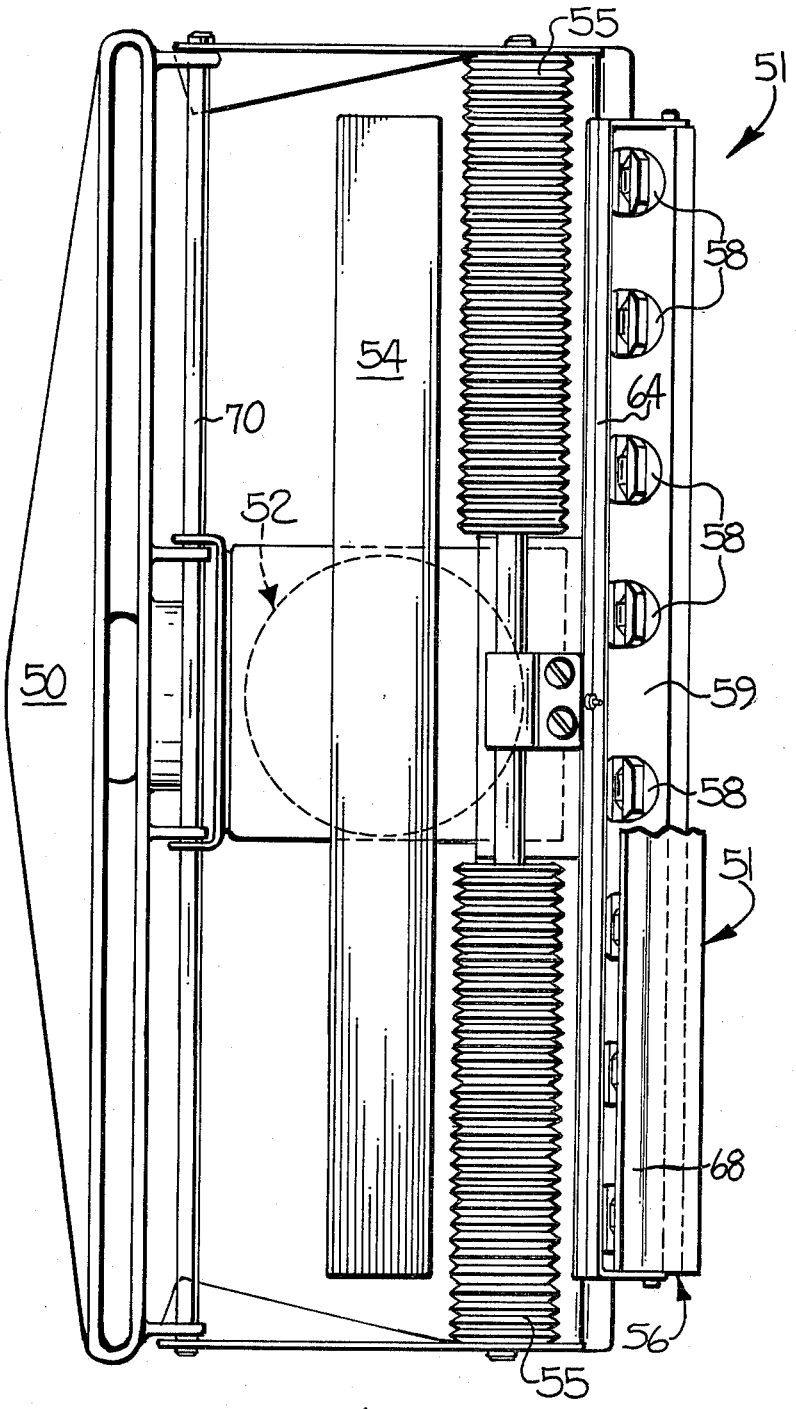
FIG. 10 is an inverted plan view of the wand elements of FIG. 9, taken generally along the line 10—10 in FIG. 9.

The sheeting means 64 takes the form of an elongate bar spanning the width of the plurality of nozzle members 58 (FIG. 10). The bar is mounted on the manifold 59 for pivotal movement and, upon movement from the withdrawn position to the sheeting position, unseats the nozzle members 58 from the seat means 60 and gaskets 61, thereby directing liquid about unseated nozzles as a low pressure spreading flow. The low pressure spreading flow is pooled onto the surface to be cleaned as a sheet, partially through the cooperation of a distributing shield 68 mounted on the manifold 59. Even distribution of the pooled sheet is further aided by the grooved spreading roller 55.

Figure 7:
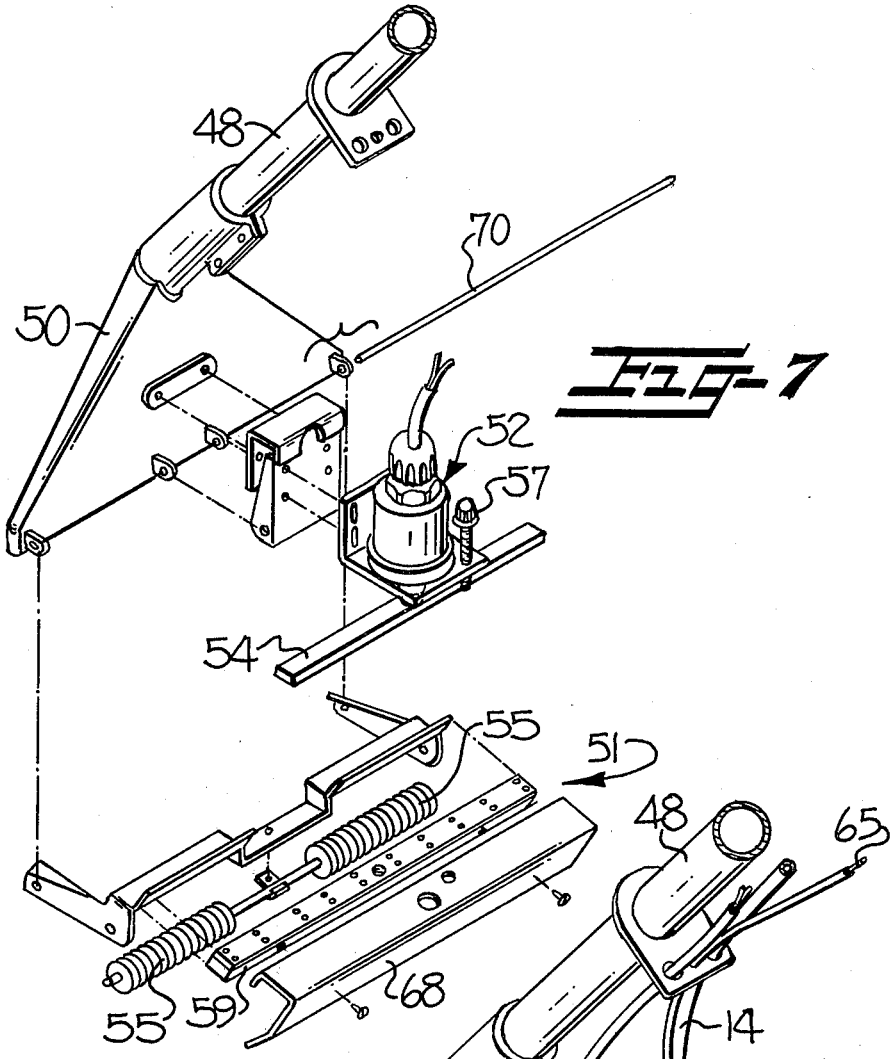
FIG. 7 is an exploded perspective view of other portions of the wand.
Figure 8:
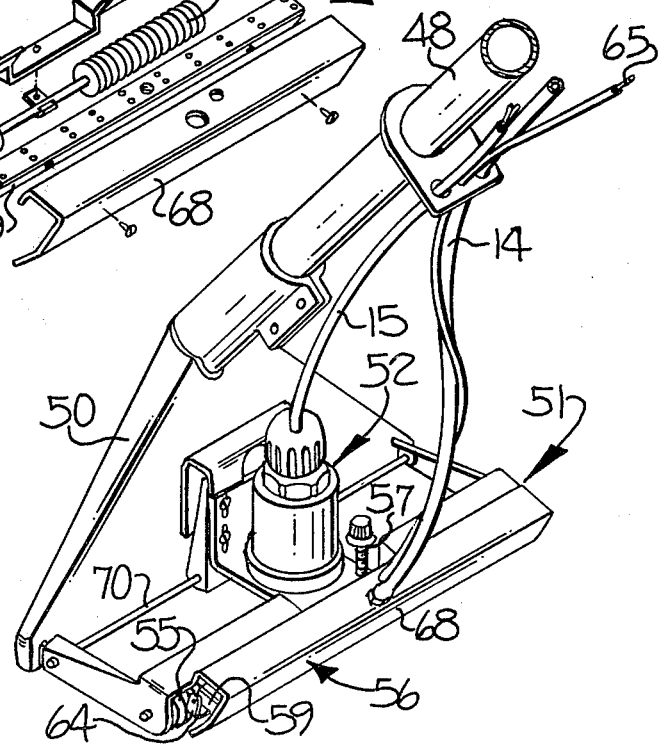
FIG. 8 is an assembled perspective view similar to FIG. 7.
Figure 9:
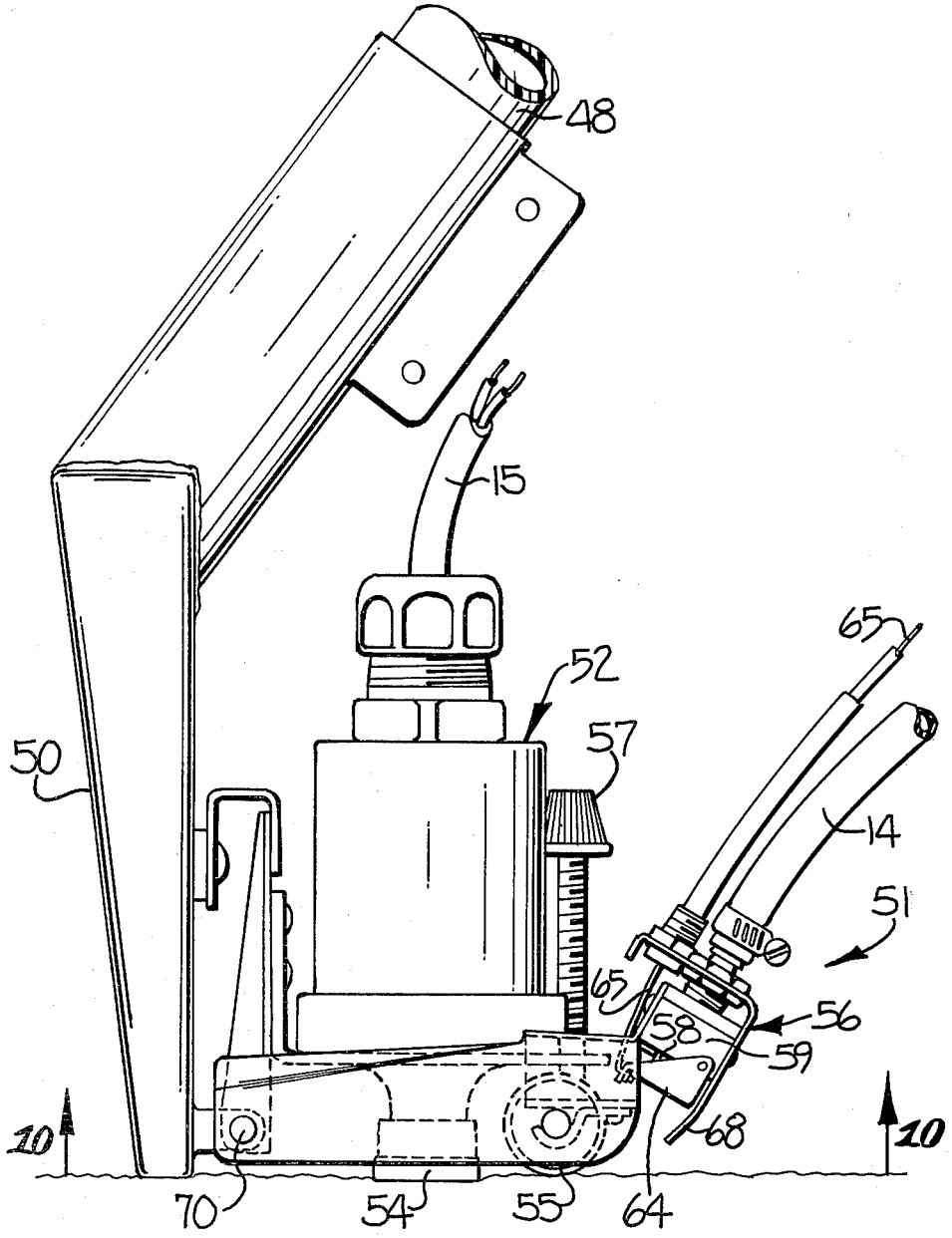
FIG. 9 is an enlarged side elevation of the wand components illustrated in FIGS. 7 and 8.

As will be particularly noted from FIGS. 7 through 9, the elements trailing the vacuum nozzle 50 of the wand 17, and particularly including the ultrasonic transducer 52 and transducer bar 54, the spreading roller 55, and the liquid application nozzles 56, are movable about a pivot rod 70 relative to the vacuum nozzle 50. That is, the bracket arrangements by which such elements are mounted accommodate at least limited relative pivotal movement therebetween. Such limited movement provides flexibility which is important with regard to proper angulation of the elements relative to one another during a stroke of an operator manipulating the wand 17.

In operation, an operator will fill the liquid supply reservoir formed in the lower portion 24 of the unit 11 and will add appropriate or necessary detergents or cleaning agents. The operator may monitor the temperature of the solution provided by an appropriate setting for the control elements provided, thereby assuring that the liquid temperature is in an appropriate range. Thereupon, an operator may energize the pump and, by appropriate tests, determine both the temperature and volume rate of flow of liquid being delivered.

Particularly with respect to carpet, effective cleaning is related to both temperature and volume rates of flow. Effective cleaning will occur with a temperature not lower than about 55 degrees Celsius. The rate of solution delivery will vary with particular carpet characteristics. For example, use of an operating embodiment in accordance with the present invention has suggested that low loop pile carpet should be cleaned with a flow rate of approximately 0.45 gallons (1.70 liters) per minute. Shag pile carpet should be cleaned with a flow rate of approximately 0.75 gallons (2.84 liters) per minute. Plush carpet is best cleaned with a flow rate of approximately 0.90 gallons (3.41 liters) per minute.

During cleaning of carpet, experimentation with an apparatus embodying the present invention has indicated that a reasonable cleaning rate may be approximately 220 square feet (20.44 square meters) of carpet per hour. Approximately 65% of such area will be anticipated not to require the use of techniques other than conventional spray application and vacuum extraction. Areas of greater dirtiness can be cleaned to essentially the same degree of cleanliness by employing pooled solution application, ultrasonic treatment, and vacuum extraction through operator manipulation of the wand controls as described above. Thus, an operator may move directly from an area of lesser dirtiness to an immediately adjacent traffic area of greater dirtiness and maintain cleaning efficiency merely by manipulation of controls available on the wand 17. In such use, it was determined that carpet was cleaned satisfactorily without the use of other spot cleaning techniques. This avoidance of the use of traffic spotter treatments is a significant advantage gained by the apparatus and method of the present invention.

By virtue of the monitoring and indication incorporated in the apparatus and method of the present invention, an operator is enabled to determine during cleaning, adjustments which may be necessary in order to optimize cleaning. That is, an operator may note that the power delivered to the ultrasonic transducer fluctuates rapidly and widely during use. Such action will be determined to be a result of the transducer bar "drowning" in solution, with the solution being delivered in an excessive quantity. Consequently, the operator may adjust solution flow to reduce solution delivery until power delivered is maintained essentially steady. Again, where poor coupling of power is obtained, as indicated by low power delivery, the adjusting screw 57 for the transducer 52 and transducer bar 54 may be adjusted to bring the bar into more direct engagement with the surface being cleaned. With some surfaces, a combination of poor coupling of power and poor cleaning may indicate a combination of poor bar contact and insufficient delivery of solution. In such an instance, solution delivery might first be increased and, if coupling is not thereby improved, solution delivery might be decreased and the bar spacing changed.

As will be appreciated from the above description, the apparatus and method of the present invention facilitates achieving optimal cleaning for carpet and other surfaces by providing an operator with great flexibility and with appropriate monitoring of and control over the variable characteristics involved. As a consequence of being able to operate a cleaning apparatus in a selected one of two distinctive modes, efficient cleaning is facilitated.

That which is claimed is:

1. In a liquid application and vacuum pick-up cleaning apparatus having a portable tank for storing liquid therein, and pump means for supplying a flow of liquid from the tank, the apparatus further including a wand having a plurality of liquid application nozzles operatively communicating with the pump means for applying liquid to a surface to be cleaned, a vacuum nozzle for extracting liquid from the surface to be cleaned; and ultrasonic transducer means positioned between said liquid application nozzles and said vacuum nozzle for subjecting liquid applied to the surface to be cleaned to agitation at ultrasonic frequencies after application of and before extraction of such liquid with respect to the surface to be cleaned; the combination therewith of an improvement facilitating effective operation of the apparatus in either selected one of two modes and comprising seat means cooperating with said liquid application nozzles for directing liquid through the same as a pressurized spray in one of said selected modes, and means for selectively effecting relative movement between said seat means and said liquid application nozzles to place the apparatus in the other of said modes and being operable to direct liquid past the nozzles as a relatively low pressure flow.

2. Apparatus according to claim 1 wherein said wand further comprises an elongate manifold communicating with said pump means and containing portions of said liquid application nozzles therein, said seat means being positioned within said manifold and normally being engaged by said nozzles, each nozzle having a confined outlet opening therein communicating with the interior of said manifold and through which said liquid application nozzles thus normally direct liquid as a spray in said one of said modes, said nozzle moving means including means for moving said nozzles relative to said manifold and away from said seat means therein, and said nozzles being constructed to define a passage thereabout in said manifold when said nozzles are moved away from said seat means so the liquid is then directed about and past the nozzles as a relatively low pressure flow in said other mode.

3. In a liquid application and vacuum pick-up cleaning apparatus having a tank and power unit with liquid storage means for storing liquid, pump means for supplying a flow of liquid, vacuum means for sucking air and liquid, and driver means for driving an ultrasonic transducer; the apparatus further having a wand with liquid application nozzles for applying liquid to a surface to be cleaned and operatively communicating with said pump means, a vacuum nozzle for extracting liquid from the surface to be cleaned and operatively communicating with said vacuum means, and ultrasonic transducer means mounted intermediate said nozzles and operatively connected to said driver means for subjecting liquid applied to the surface to be cleaned to agitation at ultrasonic frequencies after application of and before extraction of such liquid; the combination therewith of an improvement in said wand which facilitates effective operation in either selected one of two modes and comprising seat means for receiving said liquid application nozzles and for normally directing liquid through seated nozzles as a pressurized spray, said seat means being operable in an alternate mode for directing liquid about unseated nozzles as a low pressure spreading flow.

4. In a liquid application and vacuum pick-up cleaning apparatus having a tank and power unit with liquid storage means for storing liquid, pump means for supplying a flow of liquid, vacuum means for sucking air and liquid, and driver means for driving an ultrasonic transducer; the apparatus further having a wand with liquid application nozzles for applying liquid to a surface to be cleaned and operatively communicating with said pump means, a vacuum nozzle for extracting liquid from the surface to be cleaned and operatively communicating with said vacuum means, and ultrasonic transducer means mounted intermediate said nozzles and operatively connected to said driver means for subjecting liquid applied to the surface to be cleaned to agitation at ultrasonic frequencies after application of and before extraction of such liquid; the combination therewith of an improvement in said wand which facilitates effective operation in a selected one of two modes and comprising manually operable sheeting means mounted for movement relative to said liquid application nozzles to and from a withdrawn position in which liquid is directed as a pressurized spray and a sheeting position in which liquid is directed as a sheet.

5. In a liquid application and vacuum pick-up cleaning apparatus having a tank and power unit with liquid storage means for storing liquid, pump means for supplying a flow of liquid, vacuum means for sucking air and liquid, and driver means for driving an ultrasonic transducer; the apparatus further having a wand with liquid application nozzles for applying liquid to a surface to be cleaned and operatively communicating with said pump means, a vacuum nozzle for extracting liquid from the surface to be cleaned and operatively communicating with said vacuum means, and ultrasonic transducer means mounted intermediate said nozzles and operatively connected to said driver means for subjecting liquid applied to the surface to be cleaned to agitation at ultrasonic frequencies after application of and before extraction of such liquid; the combination therewith of an improvement in said wand which facilitates effective operation in either selected one of two modes and comprising seat means for receiving said liquid application nozzles and for normally directing liquid through seated nozzles as a pressurized spray, said seat means being operable in an alternate mode for directing liquid about unseated nozzles as a low pressure spreading flow; and manually operable sheeting means mounted for movement relative to said seat means to and from a withdrawn position in which said liquid application nozzles are seated and liquid is directed as a pressurized spray and a sheeting position engaging and unseating said liquid application nozzles and in which liquid is directed as a sheet.

6. Apparatus according to claim 3 or claim 4 or claim 5 and further having an improvement in said pump means which facilitates effective operation in a selected one of two modes and comprising speed control means operatively connected with said pump means for selectively varying the volume rate of liquid flow during operation of the apparatus in a mode in which volume rates of liquid delivery must differ significantly with characteristics of the surface to be cleaned.

7. In a liquid application and vacuum pick-up cleaning apparatus having a tank and power unit with liquid storage means for storing liquid, pump means for supplying a flow of liquid, vacuum means for sucking air and liquid, and driver means for driving an ultrasonic transducer; the apparatus further having a wand with liquid application nozzles for applying liquid to a surface to be cleaned and operatively communicating with said pump means, a vacuum nozzle for extracting liquid from the surface to be cleaned and operatively communicating with said vacuum means, and ultrasonic transducer means mounted intermediate said nozzles and operatively connected to said driver means for subjecting liquid applied to the surface to be cleaned to agitation at ultrasonic frequencies after application of and before extraction of such liquid; the combination therewith of an improvement in said pump means which facilitates effective operation in either selected one of two modes and comprising speed control means operatively connected with said pump means for selectively varying the volume rate of liquid flow during operation of the apparatus in modes in which volume rates of liquid delivery must differ significantly with characteristics of the surface to be cleaned.

* * * * *